US007104073B2

(12) United States Patent
Chen et al.

(10) Patent No.: US 7,104,073 B2
(45) Date of Patent: Sep. 12, 2006

(54) STIRLING REFRIGERATING SYSTEM AND COOLING CHAMBER WITH THE REFRIGERATING SYSTEM

(75) Inventors: Wei Chen, Yamatokoriyama (JP); Masaaki Masuda, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 448 days.

(21) Appl. No.: 10/415,145

(22) PCT Filed: Oct. 19, 2001

(86) PCT No.: PCT/JP01/09233

§ 371 (c)(1),
(2), (4) Date: Oct. 14, 2003

(87) PCT Pub. No.: WO02/35160

PCT Pub. Date: May 2, 2002

(65) Prior Publication Data

US 2004/0045303 A1 Mar. 11, 2004

(30) Foreign Application Priority Data

Oct. 25, 2000 (JP) ..... 2000-324865

(51) Int. Cl.
*F25B 9/00* (2006.01)

(52) U.S. Cl. ..... 62/6

(58) Field of Classification Search ..... 62/6
See application file for complete search history.

(56) References Cited

U.S. PATENT DOCUMENTS 6,205,792 B1 * 3/2001 Anderson ..... 62/6
6,347,524 B1 * 2/2002 Barrash et al. ..... 62/6
2001/0039802 A1 * 11/2001 Barrash ..... 62/6
2002/0088237 A1 * 7/2002 Rudick et al. ..... 62/6
2002/0121816 A1 * 9/2002 Qiu et al. ..... 310/51
2002/0134089 A1 * 9/2002 Rudick ..... 62/6
2003/0101733 A1 * 6/2003 Ogura et al. ..... 62/6
2004/0089012 A1 * 5/2004 Chen et al. ..... 62/277

FOREIGN PATENT DOCUMENTS

JP 62-138659 A 6/1987
JP 2000-130875 A 5/2000

* cited by examiner

*Primary Examiner*—William C. Doerrler
(74) *Attorney, Agent, or Firm*—Birch, Stewart, Kolasch & Birch, LLP

(57) ABSTRACT

A Stirling cycle refrigerating system has a pair of reversed Stirling cycle engines 3*a* and 3*b*, each comprising a warm head 8*a* and 8*b* of which the temperature rises as the reversed Stirling cycle engine is driven, a cold head 7*a* and 7*b* of which the temperature falls as the reversed Stirling cycle engine is driven, and a piston and a displacer that vibrate inside a cylinder along the axis thereof with an identical period and with a predetermined phase difference maintained. Inside a machine chamber 15, the pair of reversed Stirling cycle engines 3*a* and 3*b* is arranged coaxially with the axes thereof aligned with each other and with the cold heads 7*a* and 7*b* thereof facing away from each other, and the pistons or displacers of the pair of reversed Stirling cycle engines 3*a* and 3*b* are driven to vibrate in phase with each other. This Stirling cycle refrigerating system, despite being manufactured at low costs, offers cooling performance on the order of several hundred watts and produces no annoying vibration or noise when operating.

9 Claims, 8 Drawing Sheets

STIRLING REFRIGERATING SYSTEM AND COOLING CHAMBER WITH THE REFRIGERATING SYSTEM

This application is the national phase under 35 U.S.C. § 371 of PCT International Application No. PCT/JP01/09233 which has an International filing date of Oct. 19, 2001, which designated the United States of America.

TECHNICAL FIELD

The present invention relates to a refrigerating system exploiting the reversed Stirling cycle, and to a cooler, such as a refrigerator or freezer, provided with such a refrigerating system.

BACKGROUND ART

In recent years, much attention has been paid to a thermodynamic cycle conventionally known as the reversed Stirling cycle, and mush research has been done on Stirling cycle refrigerators exploiting it. A Stirling cycle refrigerator is an external combustion engine that has a heat absorber portion and a heat rejector portion, that adopts an environmentally harmless gas, such as helium, nitrogen, or hydrogen, as a working medium, and that is so structured that cold (cryogenic heat) is obtained in the heat absorber portion.

However, most Stirling cycle refrigerators in practical use offer cooling performance as low as a few watts or lower and are designed for cryogenic applications. That is, no Stirling cycle refrigerators have ever been in practical use as refrigerators having cooling performance on the order of several hundred watts, the rank of cooling performance most sought-after in refrigerators for home and business use.

Now, taking up as an example a typical free-piston-type reversed Stirling cycle engine (hereinafter referred to as the reversed Stirling cycle engine) shown in FIG. 11, the problems that remain to be tackled in it will be explained. In terms of its external appearance, the reversed Stirling cycle engine 186 is composed of a pressure vessel 174, a warm head 182, and a cold head 183. Inside, a working space 178 is secured, which is filled with a working medium, such as helium.

Inside a cylinder that constitutes part of the pressure vessel 174, a piston 171 and a displacer 172 are arranged coaxially so as to be slidable along the inner wall surface of the cylinder. A rod 175 has one end fixed to the displacer 172, penetrates the piston 171 at its center, and has the other end resiliently supported on the pressure vessel 174 by a displacer support spring 177. The piston 171 is resiliently supported on the pressure vessel 174 by a piston support spring 176.

The working space 178 has a compression space 181*a* and an expansion space 181*b*. The piston is made to reciprocate axially inside the compression space 181*a* with a predetermined period by a piston driving member 180, such as a linear motor, housed in a back space 179. The piston support spring 176 serves to stabilize the period of the piston 171 by keeping it substantially constant once the piston 171 starts reciprocating.

A regenerator 173, on the one hand, collects cold from the working medium moving from the expansion space 181*b* to the compression space 181*a* and accumulates the cold. The regenerator 173, on the other hand, transfers the accumulated cold to the working medium moving from the compression space 181*a* to the expansion space 181*b* and thereby cools the working medium. In this structure, the temperature of the working medium moving between the compression space 181*a* and the expansion space 181*b* varies greatly as a result of the working medium being compressed and expanded, and this makes it possible to obtain cold efficiently from the reversed Stirling cycle engine 186.

When compressed in the compression space 181*a*, the working medium passes through the regenerator 173 and moves toward the expansion space 181*b*. This causes the displacer 172 to reciprocate axially with the same period as the piston 171 and with a predetermined phase difference kept relative to the piston 171. As a result, in the expansion space 181*b*, the working medium is repeatedly compressed and expanded in such a way as to exhibit sinusoidal pressure variation.

The displacer support spring 177 has its spring constant and other parameters so set that, once the displacer 172 starts reciprocating, it stabilizes the period of the displacer 172 by keeping it equal to that of the piston 171 and keeps the phase difference relative to the piston 171 constant. Expanded in the expansion space 181*b*, the working medium becomes cooler and thus cools the cold head 183, absorbing heat from outside. On the other hand, compressed in the compression space 181*a*, the working medium becomes warmer and thus warms the warm head 182 provided at the compression space 181*a* side end of the regenerator 173, rejecting heat to outside.

To reduce the vibration of the reversed Stirling cycle engine 186 that occurs mainly axially as a result of the reciprocating movement of the piston 171 and the displacer 172, a vibration damping mechanism, composed of a vibration damping spring 184 and a block 185 made of a metal or the like and having a predetermined weight, is provided at that end of the reversed Stirling cycle engine 186 which faces away from the cold head 183.

This reversed Stirling cycle engine 186, however, generally offers cooling performance as low as, for example, several tens to a hundred and several tens of watts if its size is limited to be comparable with that of refrigeration cycle apparatus of a vapor compression type as are used in modern refrigerators for home use. Thus, to obtain cooling performance on the order of several hundred watts most sought-after on the market of home-use products, the following measures need to be taken.

First, the volume of the working medium that is compressed and expanded is increased by giving the piston 171 and the displacer 172 larger diameters. Second, the strokes (amplitudes) over which the piston 171 and the displacer 172 are made to reciprocate are increased. Third and last, the frequency at which the piston 171 and the displacer 172 are made to reciprocate is increased.

However, the first measure has the following disadvantages. To give the piston 171 and the displacer 172 larger diameters, it is necessary to give the pressure vessel 174, in which they are housed, a larger external diameter. This permits the piston 171 and the displacer 172 to stagger more in the direction perpendicular to the axis as they slide inside the cylinder, and thus makes the piston 171 and the 172 more likely to make contact with the pressure vessel 174. If such contact occurs frequently, or if an external force is unexpectedly applied to the pressure vessel 174, the breaking stress that occurs as a counteracting force is accordingly larger. This leads to trouble, such as a crack in the pressure vessel 174.

Thus, it is necessary to make the entire pressure vessel 174, including the warm head 182 and the cold head 183, somewhat thicker. Making these thicker, however, increases the weight and thus the costs of the engine as a whole.

Moreover, making the warm head 182 thicker increases heat resistance, in particular in radial directions, and thus makes it more difficult for heat to conduct to the heat exchanger for heat rejection (not shown) provided around the warm head 182, while reducing heat resistance in the axial direction and thereby making it easier for heat to conduct from the warm head 182 to the cold head 183 through the components constituting the pressure vessel 174 and the like. This lowers the efficiency of the reversed Stirling cycle engine 186. Furthermore, the larger the piston 171 and the displacer 172, the heavier the reversed Stirling cycle engine 186 as a whole, increasing the burden on the power source, the support springs, and the like.

The second measure has the following disadvantages. Since the piston 171 is resiliently supported on the pressure vessel 174 by the piston support spring 176 and the displacer 172 is resiliently supported on the pressure vessel 174 by the displacer support spring 177, increasing the strokes over which they are made to reciprocate axially increases the strokes of the support springs 176 and 177.

As their strokes are increased, the support springs 176 and 177 become more likely to receive excessive force and thus more prone to damage, such as breakage. This eventually leads to lower performance of the reversed Stirling cycle engine 186. Furthermore, as the strokes of the support springs 176 and 177 are increased, the piston driving member 180, such as a linear motor, is inevitably required to exert higher power. This increases electric power consumption, contrary to energy saving.

The third measure has the following disadvantages. The spring constants of the support springs 176 and 177 are proportional to the square of the frequency at which they are used. Thus, if an attempt is made, for example, to double the performance of a Stirling cycle refrigerator by increasing its operation frequency, the resulting vibration puts at least four times the load on the support springs 176 and 177. Given the constraints on the materials of the support springs 176 and 177, there is a risk of their elastic limit being exceeded.

Because of the problems explained above, in a home-use refrigerator that is required to offer cooling performance on the order of several hundred watts, with a single unit of the free-piston-type reversed Stirling cycle engine 186 described above, it is not possible to obtain sufficiently high cooling performance. That is, it is not possible to achieve the desired cooling effect in the space to be cooled. Moreover, the vibration damping mechanism described above is indispensable in practical terms. This increases the dimensions and weight of the reversed Stirling cycle engine 186, and thus increases its manufacturing costs accordingly.

DISCLOSURE OF THE INVENTION

An object of the present invention is to provide, at low cost, a Stirling cycle refrigerating system that offers cooling performance on the order of several hundred watts with ease and that does not produce annoying vibration or noise when operating.

To achieve the above object, according to the present invention, a Stirling cycle refrigerating system is provided with a pair of reversed Stirling cycle engines, each provided with a warm head of which the temperature rises as the reversed Stirling cycle engine is driven, a cold head of which the temperature falls as the reversed Stirling cycle engine is driven, and a piston and a displacer that vibrate inside a cylinder along the axis thereof with an identical period and with a predetermined phase difference maintained. Here, the pair of reversed Stirling cycle engines is arranged coaxially with the axes thereof aligned with each other and with the cold heads thereof facing away from each other, and the pistons or displacers of the pair of reversed Stirling cycle engines are driven to vibrate in phase with each other.

In this structure, the vibration of the reversed Stirling cycle engines, which results from the vibration of their pistons or displacers driven to vibrate in phase, cancels out and diminishes.

The pair of reversed Stirling cycle engines may be coupled together through a vibration absorbing member. This permits the vibration of the reversed Stirling cycle engines to be absorbed by the vibration absorbing member and thereby reduced.

A heat rejecting heat exchanger arranged to abut the warm heads may be shared between the pair of reversed Stirling cycle engines. This helps reduce the number of components.

Alternatively, according to the present invention, a Stirling cycle refrigerating system is provided with a pair of reversed Stirling cycle engines, each provided with a warm head of which the temperature rises as the reversed Stirling cycle engine is driven, a cold head of which the temperature falls as the reversed Stirling cycle engine is driven, and a piston and a displacer that vibrate inside a cylinder along the axis thereof with an identical period and with a predetermined phase difference maintained. Here, the pair of reversed Stirling cycle engines is arranged coaxially with the axes thereof aligned with each other and with the cold heads thereof facing each other, and the pistons or displacers of the pair of reversed Stirling cycle engines are driven to vibrate in phase with each other. Moreover, a heat absorbing heat exchanger arranged to abut the cold heads is shared between the pair of reversed Stirling cycle engines.

In this structure, the vibration of the reversed Stirling cycle engines, which results from the vibration of their pistons or displacers driven to vibrate in phase, cancels out and, diminishes. Moreover the number ofcomponents needed is reduced.

A plurality of the pair of reversed Stirling cycle engines may be arranged in parallel. This makes it possible to obtain high cooling performance at a time, and thus to realize a large cooler provided with a Stirling cycle refrigerating system.

At least one of the reversed Stirling cycle engines may be fitted with a phase sensor for detecting the phase of the vibrating piston thereof so that the other reversed Stirling cycle engines are driven in phase with the detected phase. This makes it possible, even after the reversed Stirling cycle engines have stopped being driven temporarily for defrosting or the like, to restart them by quickly bringing them into phase with the detected phase.

By incorporating such a Stirling cycle refrigerating system in a cooler, such as a refrigerator for home use, it is possible to realize a refrigerator that offers far higher output and produces far less noise than ever.

BEST MODE FOR CARRYING OUT THE INVENTION

Figure 1:
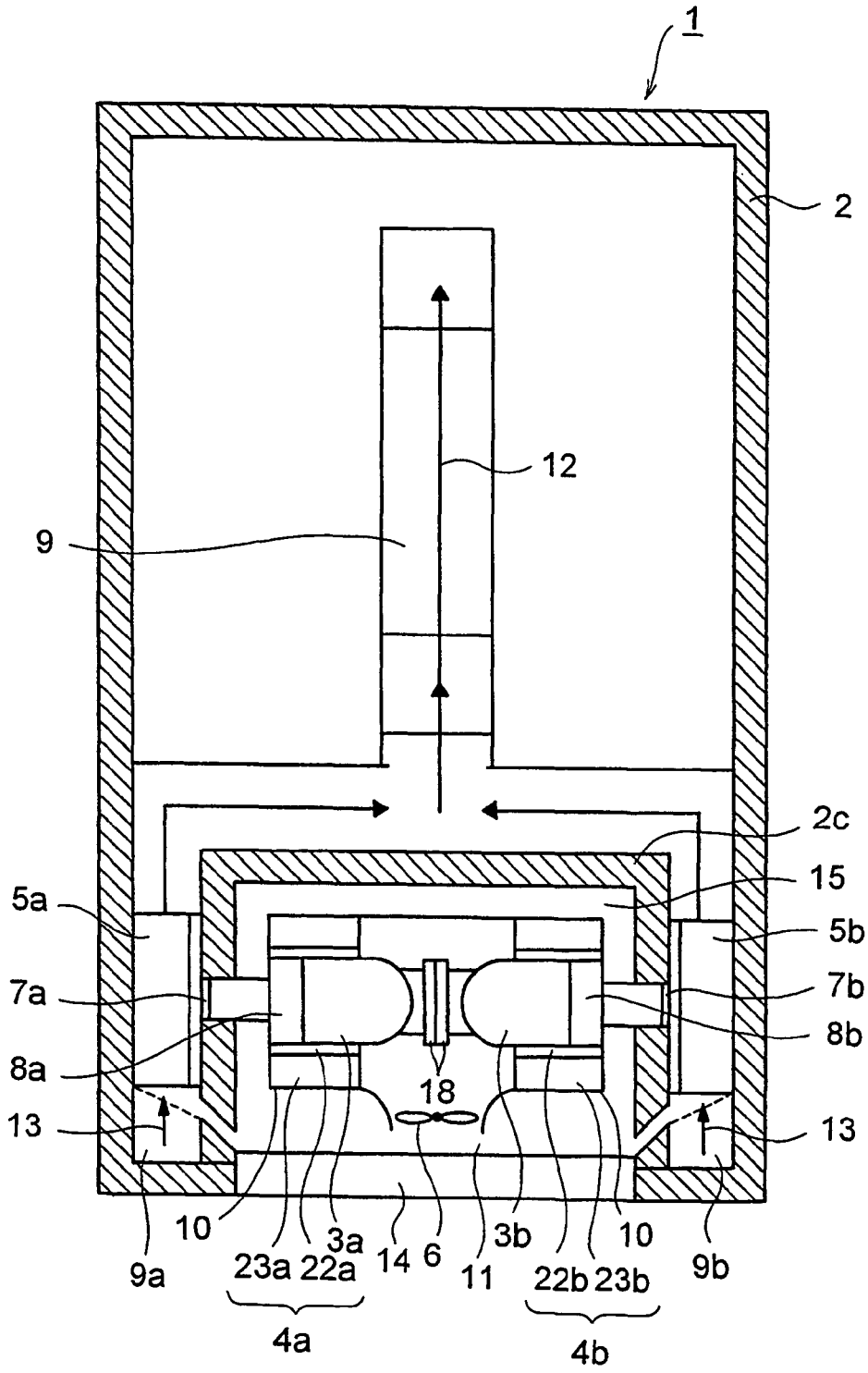
FIG. 1 is a schematic sectional view, as seen from behind, of a cooler provided with the Stirling cycle refrigerating system of a first embodiment of the invention.
Figure 2:
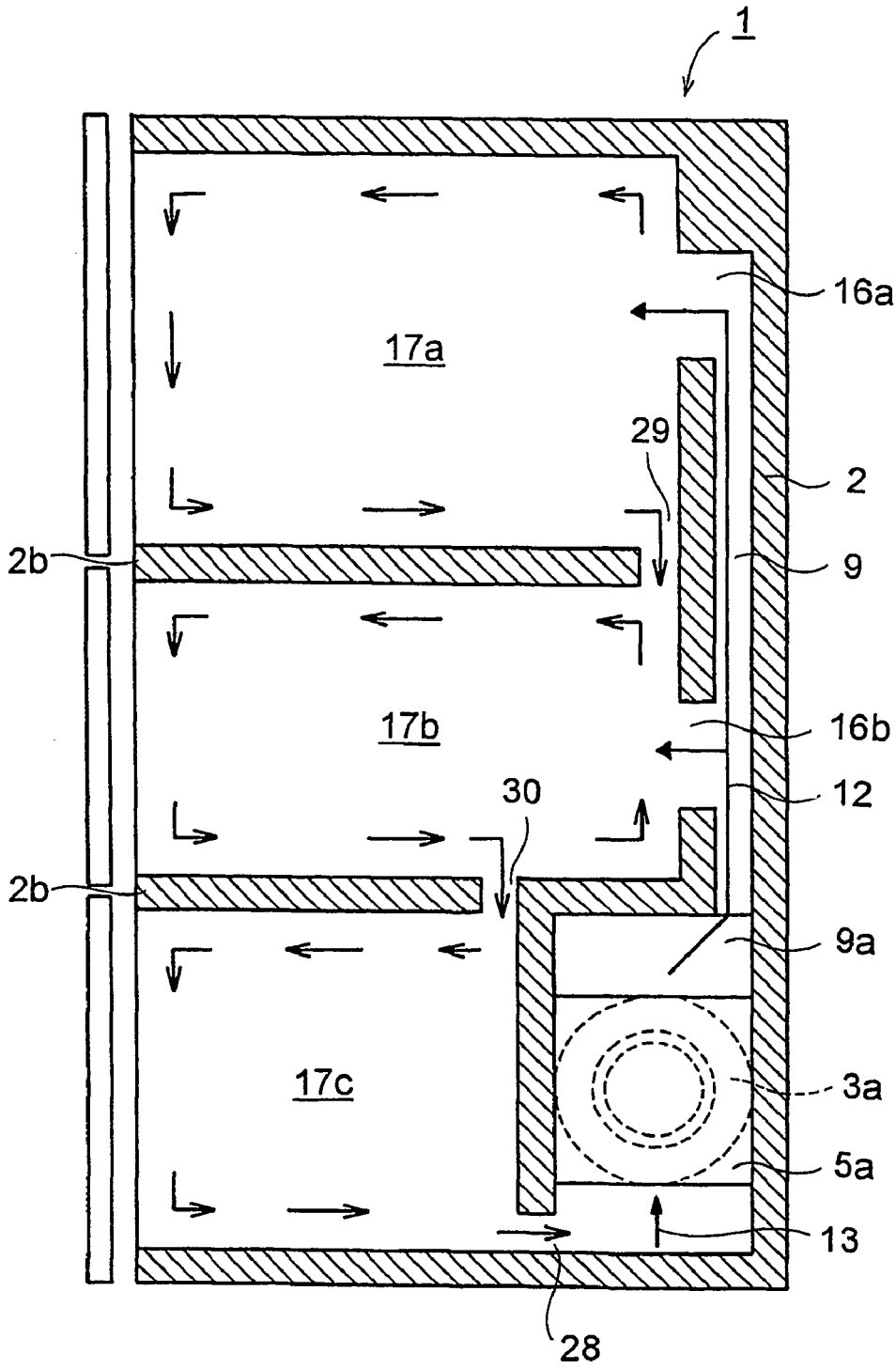
FIG. 2 is a sectional view, as seen from the side, of the cooler, substantially across the center thereof.

Hereinafter, embodiments of the present invention will be described with reference to the drawings. FIG. 1 is a sectional view, as seen from behind, showing the structure of a cooler provided with the Stirling cycle refrigerating system of a first embodiment of the invention. FIG. 2 is a sectional view, as seen from the side, of the cooler. The outermost portion of the body 1 of the cooler is composed of a heat insulating box member 2 having substantially the shape of a rectangular parallelepiped, and the space inside the heat insulating box member 2 is divided, by heat insulating walls 2*b* provided with a heat insulating material, into a first, a second, and a third refrigerator compartment 17*a*, 17*b*, and 17*c*, which each have a door fitted on the front face thereof and are each set at a different temperature. There may be any number of refrigerator compartments other than specifically cited here.

A lower rear portion of the body 1 is divided off, by a heat insulating member 2*c*, to form a machine chamber 15 for housing reversed Stirling cycle engines 3*a* and 3*b*. Inside the machine chamber 15, a substantially cylindrical air cooling duct 10 having both ends left open is arranged substantially horizontally. The machine chamber 15 is open at the back face thereof.

Substantially at the center of the air cooling duct 10 in the horizontal direction, a duct opening 11 is formed so as to be open downward, and an air cooling fan 6 for cooling the inside of the air cooling duct 10 is arranged nearby. Inside the machine chamber 15 is housed a pair of reversed Stirling cycle engines 3*a* and 3*b*, which are coupled together through vibration dumping members 18 and 18 composed of springs, rubber sheets, or the like in such a way that they are arranged symmetrically in the horizontal direction with their cold heads 7*a* and 7*b* facing away from each other.

Figure 3:
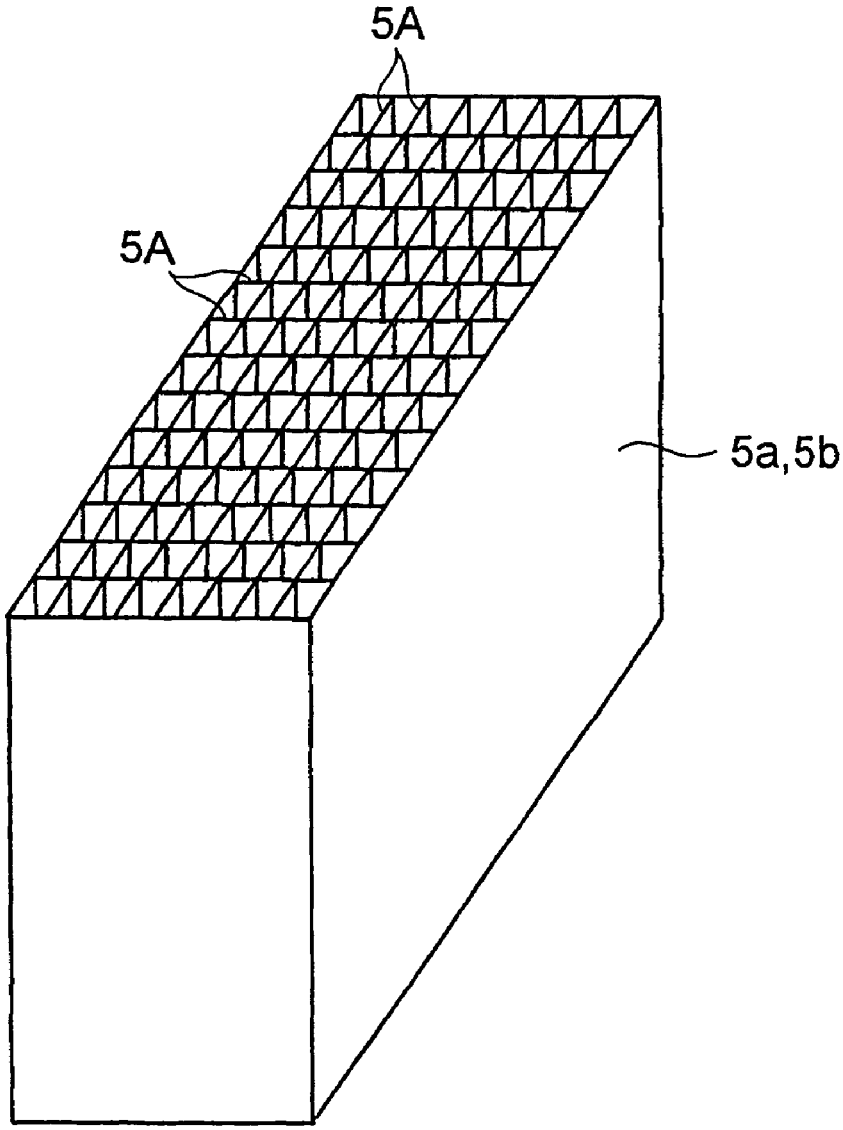
FIG. 3 is a perspective view of the heat absorbing heat exchanger of the Stirling cycle refrigerating system.

The cold heads 7*a* and 7*b* horizontally penetrate the heat insulating member 2*c* enclosing the machine chamber 15, and at the tips of the cold heads 7*a* and 7*b* are respectively fitted, in intimate contact therewith, heat absorbing heat exchangers 5*a* and 5*b* that are located inside the air flow ducts 9*a* and 9*b*, described later. As shown in FIG. 3, the heat absorbing heat exchangers 5*a* and 5*b* are metal ducts having the shape of a rectangular parallelepiped and having their top and bottom ends left open. To maximize their effective heat exchange area, inside the heat absorbing heat exchangers 5*a* and 5*b*, a plurality of partition plates 5A are arranged so as to form a lattice extending vertically.

On the other hand, on the side faces of substantially cylindrical warm heads 8*a* and 8*b*, heat rejecting heat exchangers 4*a* and 4*b* are fixed, for example, by being fitted around them. The heat rejecting heat exchangers 4*a* and 4*b* are composed of annular bases 22*a* and 22*b* having a substantially cylindrical shape and fin portions 23*a* and 23*b* composed of corrugate fins or the like and fixed all around the external periphery of the annular bases 22*a* and 22*b*.

The external diameter of the fin portions 23*a* and 23*b* of the heat rejecting heat exchangers 4*a* and 4*b* is set to be substantially equal to the internal diameter of the air cooling duct 10. Thus, the heat rejecting heat exchangers 4*a* and 4*b* are securely fixed to the inner wall of the air cooling duct 10, and thereby stabilize the positional relationship between the reversed Stirling cycle engines 3*a* and 3*b* that are arranged coaxially with their axes aligned with each other.

The air flow ducts 9*a* and 9*b* communicate, through a cold air intake opening 28, with the third refrigerator compartment 17*c*. Moreover, the air flow ducts 9*a* and 9*b* join together on their downstream side, substantially at the center of an upper portion of the machine chamber 15, to form a single air duct 9 that runs vertically along the back face of the heat insulating box member 2. The air duct 9 communicates, through cold air discharge openings 16*a* and 16*b*, with the first and second refrigerator compartments 17*a* and 17*b*. The first and second refrigerator compartments 17*a* and 17*b* respectively communicate, through vent openings 29 and 30, with the second and third refrigerator compartments 17*b* and 17*c*.

Next, the flow of cold air in the cooler structured as described above will be described. The cold produced at the cold head 7*a* and 7*b* as the reversed Stirling cycle engines 3*a* and 3*b* are driven conducts to the heat absorbing heat exchangers 5*a* and 5*b*, which absorbs the heat of the air inside the air flow ducts 9*a* and 9*b* and thereby produce cold air 12.

The cold air 12 flows through the air flow duct 9*a* and then through the air flow duct 9 so as to flow through the cold air discharge openings 16*a* and 16*b* into the first and second refrigerator compartments 17*a* and 17*b*. After circulating inside the first and second refrigerator compartments 17*a* and 17*b*, the cold air 12 flows further down through the vent openings 29 and 30 so as to flow into the third refrigerator compartment 17*c* and cool it.

After circulating inside the third refrigerator compartment 17*c* and becoming warmer, the cold air 12, now as returning cold air 13, flows through the cold air intake opening 28 into the air flow ducts 9*a* and 9*b* and returns to the upstream side of the heat absorbing heat exchangers 5*a* and 5*b*. Cold air is repeatedly circulated in this way, so that the temperatures inside the first, second, and third refrigerator compartments 17*a*, 17*b*, and 17*c* fall, cooling the articles to be cooled, such as food, placed therein to the specified temperatures.

On the other hand, as the reversed Stirling cycle engines 3*a* and 3*b* are driven, the warm heads 8*a* and 8*b* accumulate heat and become warmer. By the action of the air cooling fan 6, outside air is sucked through the open back face of the machine chamber 5 into the air cooling duct 10. Thus, the warm heads 8*a* and 8*b* exchange heat with the air through the heat rejecting heat exchangers 4*a* and 4*b* and are thereby cooled. After collecting waste heat in this way, the air is discharged through the open back face of the machine chamber 5 to outside.

Right below the duct opening 11, a drain pan 14 for collecting water drained through defrosting or the like is provided. By the action of the air cooling fan 6 as described above, the waste heat produced at the warm heads 8*a* and 8*b* of the reversed Stirling cycle engines 3*a* and 3*b* may be blown into the drain pan 14 to evaporate the drained water collected in the drain pan 14. This eliminates the trouble of periodically taking out the drain pan 14 to dispose of drained water, and thus makes maintenance-free disposal of drained water possible.

Figure 4A:
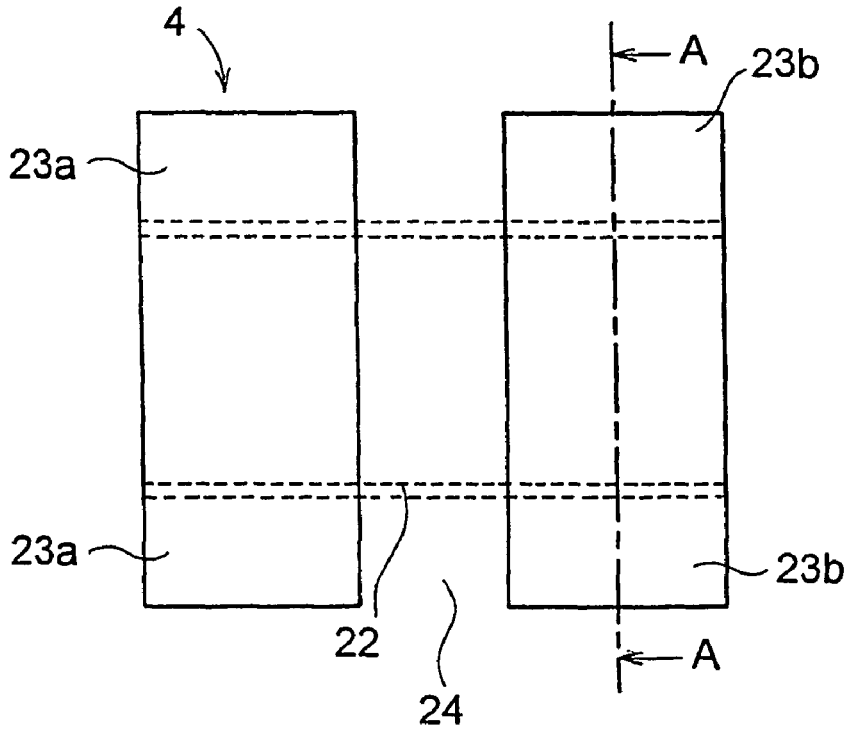
FIG. 4A is a side view of an example of the heat rejecting heat exchanger of the Stirling cycle refrigerating system.
Figure 4B:
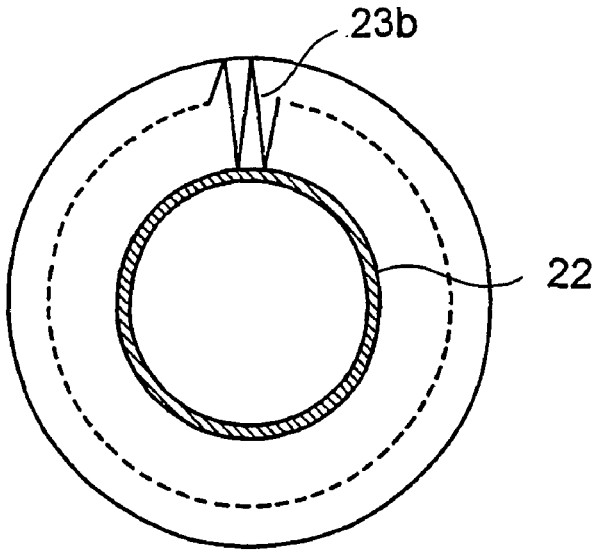
FIG. 4B is a sectional view taken along line A—A shown in FIG. 4.

The heat rejecting heat exchangers 4*a* and 4*b* may be provided as separate components, or may by provided as a single unit as shown in a plan view in FIG. 4A and in a sectional view, taken along line A—A, in FIG. 4B. In the latter case, the heat rejecting heat exchanger 4 is composed of an annular base portion 22 made of a material that conducts heat well and having a substantially cylindrical shape and fin portions 23*a* and 23*b* fixed at both ends of the annular base portion 22, for example, by being fitted around it with a space 24 secured in between and formed of members, such as corrugate fins, offering high heat conductivity. In this structure, the annular base 22 is shared between the two warm heads 8*a* and 8*b*. This helps reduce the number of components, simplify the assembly process, and reduce the costs as compared with a case where the warm heads 8*a* and 8*b* are provided with separate annular bases 22 as shown in FIG. 1.

In this case, the length of the annular base 22 in the axial direction is set equal to the tip-to-tip distance of the warm heads 8*a* and 8*b* of the pair of reversed Stirling cycle engines 3*a* and 3*b* coupled together as shown in FIG. 1, and, to prompt the rejection of heat from the warm heads 8*a* and 8*b*, the length of the fin portions 23*a* and 23*b* in the axial direction is set to be at least longer than the warm heads 8*a* and 8*b*. Thus, the outside air introduced by the air cooling fan 6 (see FIG. 1) flows from the space 24, located inside, to the fin portions 23*a* and 23*b*, located outside. This permits efficient rejection of heat from the warm heads 8*a* and 8*b*. To ease the flow of air in the radial directions of the heat rejecting heat exchanger 4, a fin, such as a pin fin, may be fitted in the space 24.

By driving the pistons and displacers of the pair of reversed Stirling cycle engines while maintaining an identical phase difference and an identical operation frequency, it is possible to cancel out the vibration resulting from the reciprocating movement of the pistons and displacers. This makes it possible to omit a vibration damping mechanism as is conventionally required, and thus helps reduce the number of components, simplify the assembly process, and greatly reduce the costs.

Figure 5:
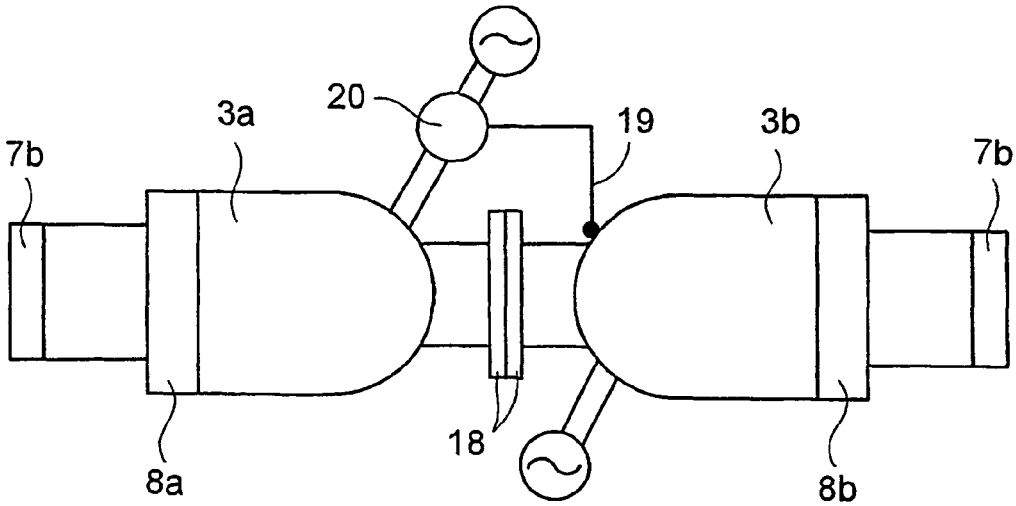
FIG. 5 is a side view of the Stirling cycle refrigerating system, illustrating an example of the control thereof.

The refrigerating system employing a plurality of reversed Stirling cycle engines 3*a* and 3*b* may adopt a structure as shown in FIG. 5 so that the reversed Stirling cycle engines can be stopped or driven individually depending on use. Specifically, of the two reversed Stirling cycle engines 3*a* and 3*b*, one 3*b* is fitted with a vibration phase sensor 19. The signal from the vibration phase sensor 19 is fed to a controller 20 that controls the driving of the linear motor or the like.

For example, when the other reversed Stirling cycle engine 3*a* has stopped being driven temporarily for defrosting or the like, how its operation is restarted will be described below. First, the vibration phase sensor 19 detects the vibration of the reversed Stirling cycle engine 3*b* being driven. On the basis of the signal from the vibration phase sensor 19, the controller 20 calculates the phase of the reciprocating movement of the piston and displacer of the reversed Stirling cycle engine 3*b*, and drives the linear motor or the like of the reversed Stirling cycle engine 3*a* so that it operates in phase with the calculated phase.

Moreover, when the operation of the stopped reversed Stirling cycle engine 3*a* is restarted, the vibration of the reversed Stirling cycle engine 3*b* being driven is sufficiently damped by being absorbed by the vibration damping members 18, and thus the effect of this vibration can be ignored. This makes it possible to restart the operation of the reversed Stirling cycle engine 3*a* by quickly bringing the phase of its reciprocating movement into phase with that of the reversed Stirling cycle engine 3*b*.

Figure 6:
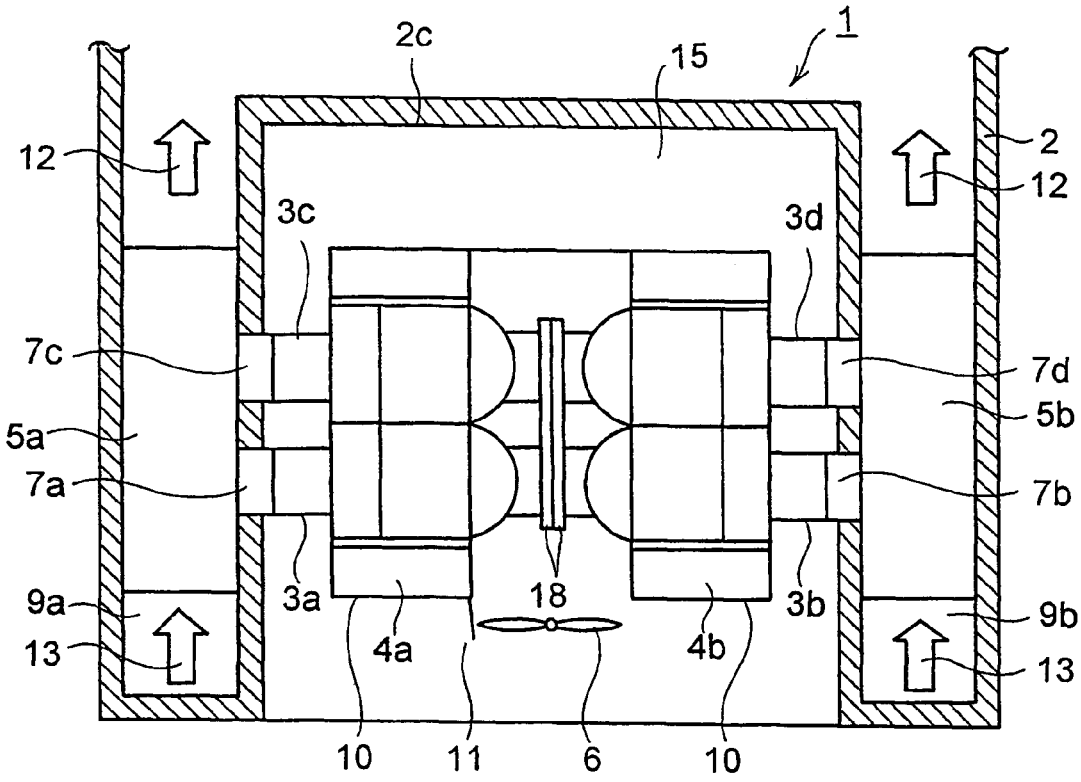
FIG. 6 is a schematic sectional view, as seen from behind, of a principal portion of another example of the cooler.

As another example of this embodiment, it is also possible to adopt a structure as shown in FIG. 6. Specifically, in parallel with the pair of reversed Stirling cycle engines 3*a* and 3*b*, another pair of reversed Stirling cycle engines 3*c* and 3*d* is provided in the machine chamber 15. This makes it possible to obtain sufficiently high cooling performance even in a refrigerating apparatus, such as a large refrigerator, that is required to offer high output. In this case, by sharing the heat rejecting heat exchangers 4*a* and 4*b*, heat absorbing heat exchangers 5*a* and 5*b*, and the vibration damping members 18 as shown in the figure, it is possible to reduce the number of components and reduce the costs. More pairs of reversed Stirling cycle engines may be provided in parallel.

Figure 7:
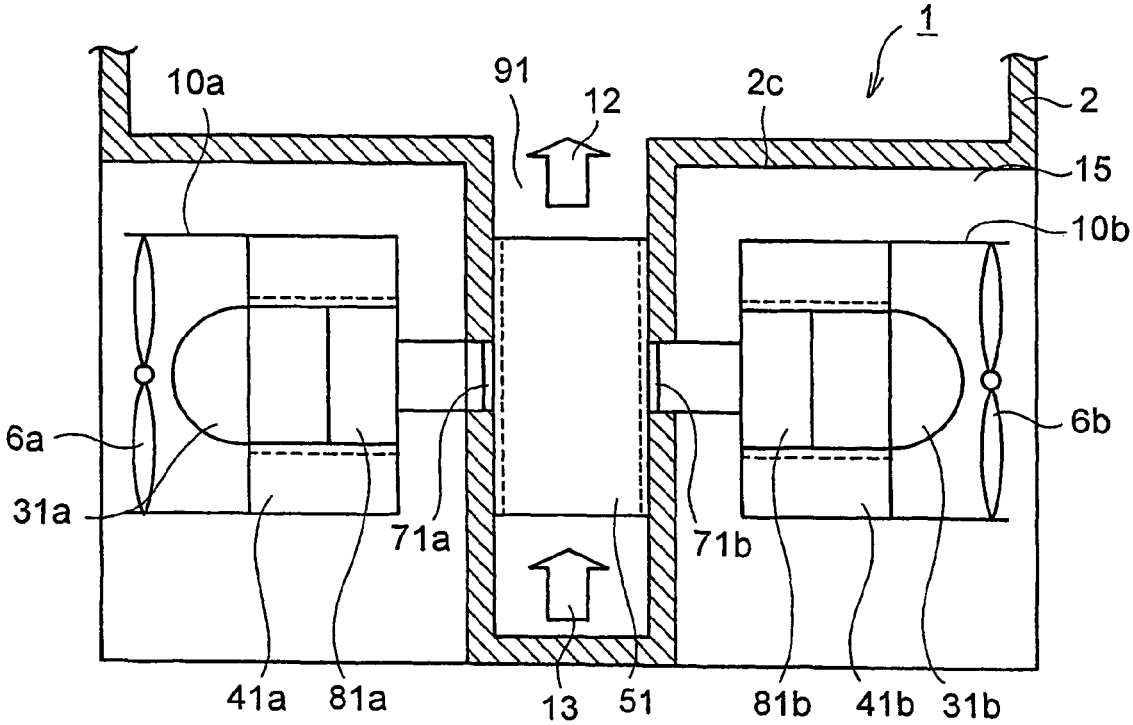
FIG. 7 is a schematic sectional view, as seen from behind, of a principal portion of a cooler provided with the Stirling cycle refrigerating system of a second embodiment of the invention.

FIG. 7 is a sectional view, as seen from behind, of a principal portion of a cooler provided with the Stirling cycle refrigerating system of a second embodiment of the invention. A lower rear portion of the body 1 of the cooler is divided off, by a heat insulating member 2*c*, to form a machine chambers 15. A substantially central portion of the body 1 in its width direction, i.e. the portion thereof between the machine chambers 15, forms an air flow duct 91, which communicates with refrigerator compartments 17*a*, 17*b*, and 17*c* formed inside a heat insulating box member 2 (see FIG. 2).

Moreover, inside the machine chambers 15, a pair of air cooling ducts 10*a* and 10*b* having a substantially cylindrical shape and having both ends left open is arranged substantially parallel to the width direction of the body 1.

At the sides of the air cooling ducts 10*a* and 10*b* are respectively arranged air cooling fans 6*a* and 6*b* for cooling the inside of the air cooling ducts 10*a* and 10*b*. Inside the air cooling ducts 10*a* and 10*b*, a pair of reversed Stirling cycle engines 31*a* and 31*b* is arranged symmetrically in the horizontal direction with their cold heads 71*a* and 71*b* facing each other.

Inside the air flow duct 91, a heat absorbing heat exchanger 51 having substantially the shape of a rectangular parallelepiped and having its top and bottom ends left open is arranged so as to make contact with the wall surfaces on both sides thereof. The tips of the cold heads 71*a* and 71*b* of the reversed Stirling cycle engines 31*a* and 31*b* penetrate the heat insulating member 2*c* and touch the side faces of the heat absorbing heat exchanger 51.

Figure 8:
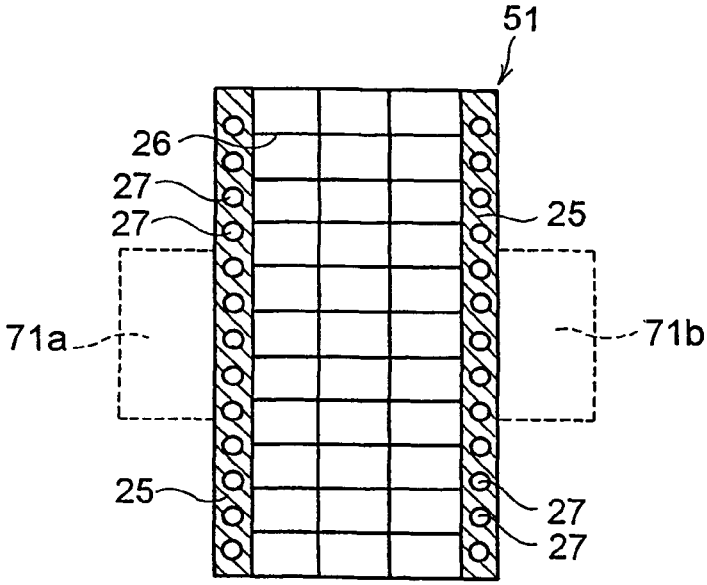
FIG. 8 is a sectional view of an example of the heat absorbing heat exchanger of the Stirling cycle refrigerating system.

FIG. 8 shows the details of the heat absorbing heat exchanger 51. FIG. 8 is a horizontal sectional view of the heat absorbing heat exchanger 51. It has two plate-shaped base portions 25 and 25 formed of members that conduct heat well where the cold heads 71 and 7*b* on both sides make contact with it, and between these plate-shaped base portions 25 and 25 is sandwiched a fin portion 26 such as formed of flat fins.

In the base portions 25, a plurality of horizontally extending heat pipes 27 are arranged vertically. In the heat pipes 27, a refrigerant, such as carbon dioxide or pentane, is sealed. Inside the heat pipes 27, the refrigerant changes its phase, from liquid to gas and vice versa, according to variation in temperature. Specifically, the refrigerant vaporizes as it receives latent heat, and, as it is cooled, it condenses back into liquid, rejecting the latent heat evenly from all over the surface of the heat pipes 25. This helps reduce the heat resistance of the plate-shaped base portions 25 and make its temperature even. This enhances the heat exchange efficiency of the heat absorbing heat exchanger 51.

On the other hand, on the side faces of substantially cylindrical warm heads 81*a* and 81*b*, heat rejecting heat exchangers 41*a* and 41*b* are fixed, for example, by being fitted around them. The external diameter of the heat rejecting heat exchangers 41*a* and 41*b* is set to be substantially equal to the internal diameter of the air cooling ducts 10*a* and 10*b*. Thus, the heat rejecting heat exchangers 41*a* and 41*b* are securely fixed to the inner walls of the air cooling ducts 10*a* and 10*b*, and thereby stabilize the positional relationship between the reversed Stirling cycle engines 31*a* and 31*b* that are arranged coaxially with their axes aligned with each other.

The air flow ducts 9*a* and 9*b* communicate, through a cold air intake opening 28 (see FIG. 2), with the third refrigerator compartment 17*c* (see FIG. 2). Moreover, the air flow ducts 9*a* and 9*b* join together on their downstream side, substantially at the center of an upper portion of the machine chamber 15, to form a single air duct 9 that runs vertically along the back face of the heat insulating box member 2. The air duct 9 communicates, through cold air discharge openings 16*a* and 16*b*, with the first and second refrigerator compartments 17*a* and 17*b* (see FIG. 2). The first and second refrigerator compartments 17*a* and 17*b* respectively communicate, through vent openings 29 and 30 (see FIG. 2), with the second and third refrigerator compartments 17*b* and 17*c*.

Next, the flow of cold air in the cooler structured as described above will be described.

The cold produced at the cold head 71*a* and 71*b* as the reversed Stirling cycle engines 31*a* and 31*b* are driven conducts to the heat absorbing heat exchanger 51, which absorbs the heat of the air inside the air flow duct 91 and thereby produces cold air 12.

The cold air 12 flows through the air flow duct 9 so as to flow through the cold air discharge openings 16*a* and 16*b* (see FIG. 2) into the first and second refrigerator compartments 17*a* and 17*b* (see FIG. 2). After circulating inside the first and second refrigerator compartments 17*a* and 17*b*, the cold air 12 flows further down through the vent openings 29 and 30 (see FIG. 2) so as to flow into the third refrigerator compartment 17*c* (see FIG. 2) and cool it.

After circulating inside the third refrigerator compartment 17*c* and becoming warmer, the cold air 12, now as returning cold air 13, flows through the cold air intake opening 28 (see FIG. 1) into the air flow duct 91 and returns to the upstream side of the heat absorbing heat exchanger 51. Cold air is repeatedly circulated in this way, so that the temperatures inside the first, second, and third refrigerator compartments 17*a*, 17*b*, and 17*c* fall, cooling the articles to be cooled, such as food, placed therein to the specified temperatures.

On the other hand, as the reversed Stirling cycle engines 3*a* and 3*b* are driven, the warm heads 8*a* and 8*b* accumulate heat and become warmer. By the action of the air cooling fans 6*a* and 6*b*, outside air is sucked through the open back face of the machine chambers 5 into the air cooling duct 10. Thus, the warm heads 81*a* and 81*b* exchange heat with the air through the heat rejecting heat exchangers 41*a* and 41*b* and are thereby cooled. After collecting waste heat in this way, the air is discharged through the open back face of the machine chambers 5 to outside.

Figure 9:
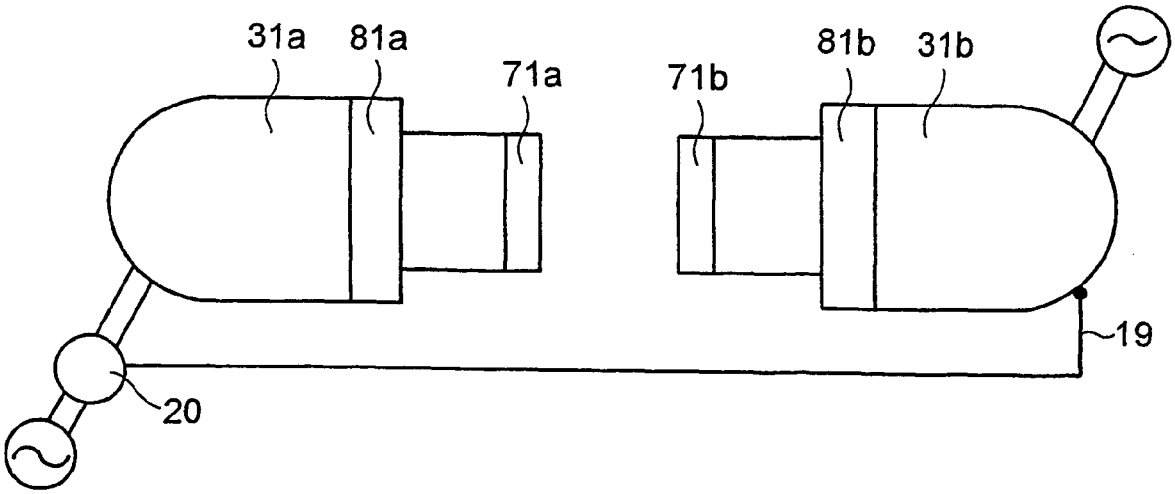
FIG. 9 is a side view of the Stirling cycle refrigerating system, illustrating an example of the control thereof.

The refrigerating system employing a plurality of reversed Stirling cycle engines 31*a* and 31*b* may adopt a structure as shown in FIG. 9 so that the reversed Stirling cycle engines can be stopped or driven individually depending on use. Specifically, of the two reversed Stirling cycle engines 31*a* and 31*b*, one 31*b* is fitted with a vibration phase sensor 19. The signal from the vibration phase sensor 19 is fed to a controller 20 that controls the driving of the linear motor or the like.

For example, when the other reversed Stirling cycle engine 31*a* has stopped being driven, how its operation is restarted will be described below. First, the vibration phase sensor 19 detects the vibration of the reversed Stirling cycle engine 31*b* being driven. On the basis of the signal from the vibration phase sensor 19, the controller 20 calculates the phase of the reciprocating movement of the piston and displacer of the reversed Stirling cycle engine 31*b*, and drives the linear motor of the reversed Stirling cycle engine 31*a* so that it operates in phase with the calculated phase.

In this way, when the reversed Stirling cycle engine 31*a* that has stopped being driven temporarily for defrosting or the like is restarted, it is possible to restart its operation by quickly bringing it into phase with the other reversed Stirling cycle engine 3*b* being driven.

Figure 10:
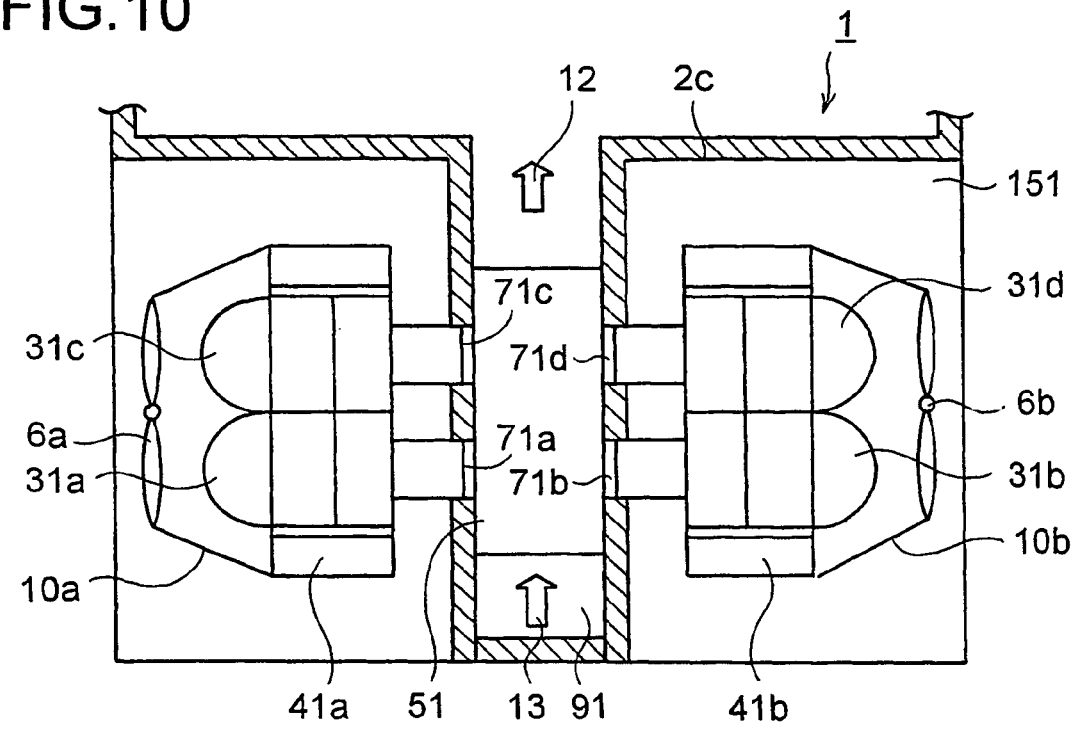
FIG. 10 is a schematic sectional view, as seen from behind, of a principal portion of another example of the cooler.
Figure 11:
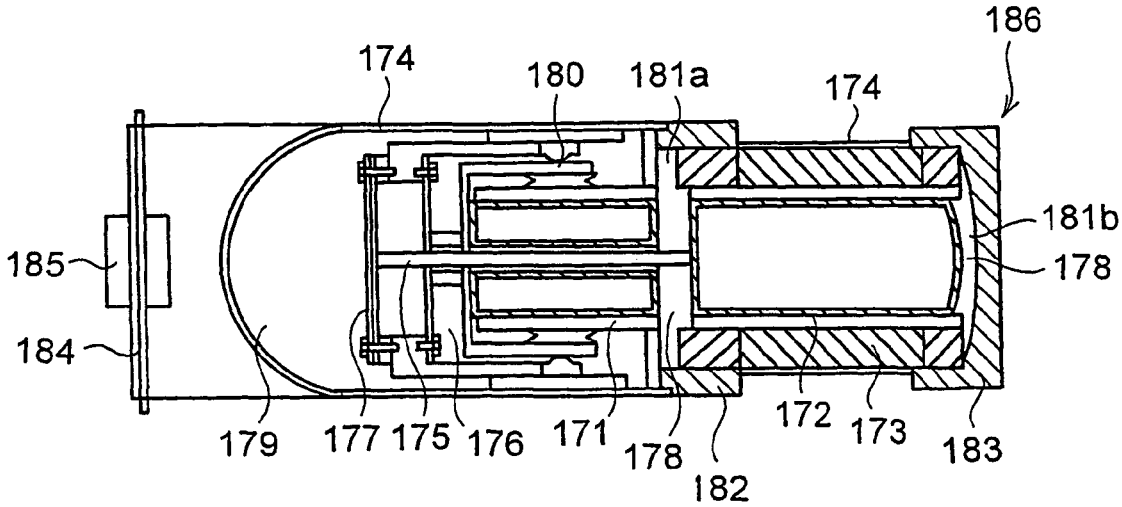
FIG. 11 is a sectional view of an example of a free-piston-type reversed Stirling cycle engine.

As another example of this embodiment, it is also possible to adopt a structure as shown in FIG. 10. Specifically, in parallel with the pair of reversed Stirling cycle engines 31*a* and 31*b*, another pair of reversed Stirling cycle engines 31*c* and 31*d* is provided in the machine chambers 15. This makes it possible to obtain sufficiently high cooling performance even in a refrigerating apparatus, such as a large refrigerator, that is required to offer high output. More pairs of reversed Stirling cycle engines may be provided in parallel.

INDUSTRIAL APPLICABILITY

As described above, according to the present invention, a pair of reversed Stirling cycle engines, each provided with a piston and a displacer that vibrate inside a cylinder along the axis thereof with an identical period and with a predetermined phase difference maintained, is arranged coaxially with the axes thereof aligned with each other, and the pistons or displacers of the pair of reversed Stirling cycle engines are driven to vibrate in phase with each other. Thus, the vibration of the reversed Stirling cycle engines cancels out. This eliminates the need to provide a vibration damping mechanism as is conventionally used, and thus helps reduce the costs of Stirling refrigerating system.

In particular, if the pair of reversed Stirling cycle engines is arranged with their cold heads facing away from each other, the two reversed Stirling cycle engines can be coupled together through a vibration absorbing member, such as vibration damping rubber. This helps realize a Stirling cycle refrigerating system that operates with less vibration and thus more quietly.

By sharing the heat rejecting heat exchanger fitted to the warm heads and the heat absorbing heat exchanger fitted to the cold heads between the pair of reversed Stirling cycle engines, it is possible to reduce the number of components, simplify the assembly process, and reduce the costs.

By arranging a plurality of such pairs of reversed Stirling cycle engines in parallel, it is possible to obtain a sufficiently high cooling performance from the reversed Stirling cycle engines even in a refrigerating apparatus, such as a large refrigerator, that is required to offer high output.

By fitting at least one of a plurality of reversed Stirling cycle engines with a phase sensor for detecting the phase of the vibrating piston thereof, and controlling the driving of the other reversed Stirling cycle engines in phase with the detected phase, it is possible to quickly start driving the pistons or displacers of a pair of reversed Stirling cycle engines to vibrate in phase with each other.

The invention claimed is:

1. A Stirling cycle refrigerating system comprising a pair of reversed Stirling cycle engines, each comprising a warm head of which the temperature rises as the reversed Stirling cycle engine is driven, a cold head of which the temperature falls as the reversed Stirling cycle engine is driven, and a piston and a displacer that vibrate inside a cylinder along an axis thereof with an identical period and with a predetermined phase difference maintained, wherein the pair of reversed Stirling cycle engines is arranged coaxially with the axes thereof aligned with each other and with the cold heads thereof facing away from each other, and the pistons or displacers of the pair of reversed Stirling cycle engines are driven to vibrate in phase with each other.

2. A Stirling cycle refrigerating system as claimed in claim 1, wherein the pair of reversed Stirling cycle engines is coupled together through a vibration absorbing member.

3. A Stirling cycle refrigerating system as claimed in claim 2, wherein a heat rejecting heat exchanger arranged to abut the warm heads is shared between the pair of reversed Stirling cycle engines.

4. A Stirling cycle refrigerating system as claimed in claim 3, wherein a plurality of the pair of reversed Stirling cycle engines are arranged in parallel.

5. A Stirling cycle refrigerating system as claimed in claim 4, wherein at least one of the reversed Stirling cycle engines is fitted with a phase sensor for detecting a phase of the vibrating piston thereof, and the other reversed Stirling cycle engines are driven in phase with the detected phase.

6. A Stirling cycle refrigerating system comprising a pair of reversed Stirling cycle engines, each comprising a warm head of which the temperature rises as the reversed Stirling cycle engine is driven, a cold head of which the temperature falls as the reversed Stirling cycle engine is driven, and a piston and a displaces that vibrate inside a cylinder along an axis thereof with an identical period and with a predetermined phase difference maintained, wherein the pair of reversed Stirling cycle engines is arranged coaxially with the axes thereof aligned with each other and with the cold heads thereof facing each other, and the pistons or displacers of the pair of reversed Stirling cycle engines are driven to vibrate in phase with each other, and a heat absorbing heat exchanger arranged to abut the cold heads is shared between the pair of reversed Stirling cycle engines.

7. A Stirling cycle refrigerating system as claimed in claim 6, wherein a plurality of the pair of reversed Stirling cycle engines is arranged in parallel.

8. A Stirling cycle refrigerating system as claimed in claim 7, wherein at least one of the reversed Stirling cycle engines is fitted with a phase sensor for detecting a phase of the vibrating piston thereof, and the other reversed Stirling cycle engines are driven in phase with the detected phase.

9. A cooler comprising a Stirling cycle refrigerating system as claimed in claim 1.

* * * * *